US007258407B1

(12) United States Patent
Stelter et al.

(10) Patent No.: US 7,258,407 B1
(45) Date of Patent: Aug. 21, 2007

(54) CUSTOM COLOR PRINTING APPARATUS AND PROCESS

(75) Inventors: Eric C. Stelter, Pittsford, NY (US); John R. Thompson, Las Vegas, NV (US)

(73) Assignee: Eastman Kodak Company, Rochester, NY (US)

( * ) Notice: Subject to any disclaimer, the term of this patent is extended or adjusted under 35 U.S.C. 154(b) by 172 days.

(21) Appl. No.: 10/807,794

(22) Filed: Mar. 24, 2004

Related U.S. Application Data

(60) Provisional application No. 60/458,789, filed on Mar. 28, 2003.

(51) Int. Cl.
*B41J 2/195* (2006.01)

(52) U.S. Cl. ..... 347/7; 347/84; 347/85

(58) Field of Classification Search ..... 347/7
See application file for complete search history.

(56) References Cited

U.S. PATENT DOCUMENTS 6,474,795 B1 11/2002 Lebens et al.
6,485,137 B2 * 11/2002 Karlinski et al. ..... 347/92
6,494,553 B1 * 12/2002 Donahue et al. ..... 347/7
6,517,261 B1 2/2003 Piccinino, Jr. et al.
6,550,892 B1 * 4/2003 Sharma ..... 347/43
6,592,271 B1 7/2003 Piccinino, Jr. et al.
6,663,301 B2 12/2003 Piccinino, Jr. et al.
6,695,440 B2 2/2004 Lebens et al.
6,796,641 B2 9/2004 Lebens et al.
6,832,824 B1 * 12/2004 Baker et al. ..... 347/19
6,938,984 B2 * 9/2005 German et al. ..... 347/43
2005/0083367 A1 * 4/2005 Nakamura ..... 347/22

* cited by examiner

*Primary Examiner*—Matthew Luu
*Assistant Examiner*—Brian J. Goldberg
(74) *Attorney, Agent, or Firm*—Donna P Suchy

(57) ABSTRACT

The invention relates to the use of custom color inks in printing. According to various aspects of the invention, printing apparatus and processes are provided for dispensing a first primary color ink to a custom color chamber associated with a print head, dispensing a second primary color ink to the custom color chamber, mixing the first primary color ink and the second primary color ink to create a custom color, and printing the custom color ink from the custom color chamber with a print head. The invention also relates to using valves to select a printing ink from a number of available ink chambers.

22 Claims, 4 Drawing Sheets

CUSTOM COLOR PRINTING APPARATUS AND PROCESS

CROSS-REFERENCE TO RELATED APPLICATIONS

This application claims the benefit of U.S. Provisional Patent Application Ser. No. 60/458,789 filed Mar. 28, 2003.

BACKGROUND

The invention relates to the use of custom color inks in printing.

In printing, custom colors are often used for accent colors. For use with printing presses, custom color inks are pre-mixed and are typically used for large runs with long setup times for each job. Such pre-mixing of large batches is inefficient for smaller print jobs that make use of custom colors, and setup and cleanup can be difficult and time consuming.

SUMMARY

According to various aspects of the invention, printing apparatus and processes are provided for dispensing a first primary color ink to a custom color chamber associated with a print head; dispensing a second primary color ink to the custom color chamber; mixing the first primary color ink and the second primary color ink to create a custom color; and printing the custom color ink from the custom color chamber with a print head. A related aspect of the invention is an arrangement of valves for selecting a printing ink from a number of available ink chambers, and feeding the selected ink to a print head.

DETAILED DESCRIPTION

Figure 1:
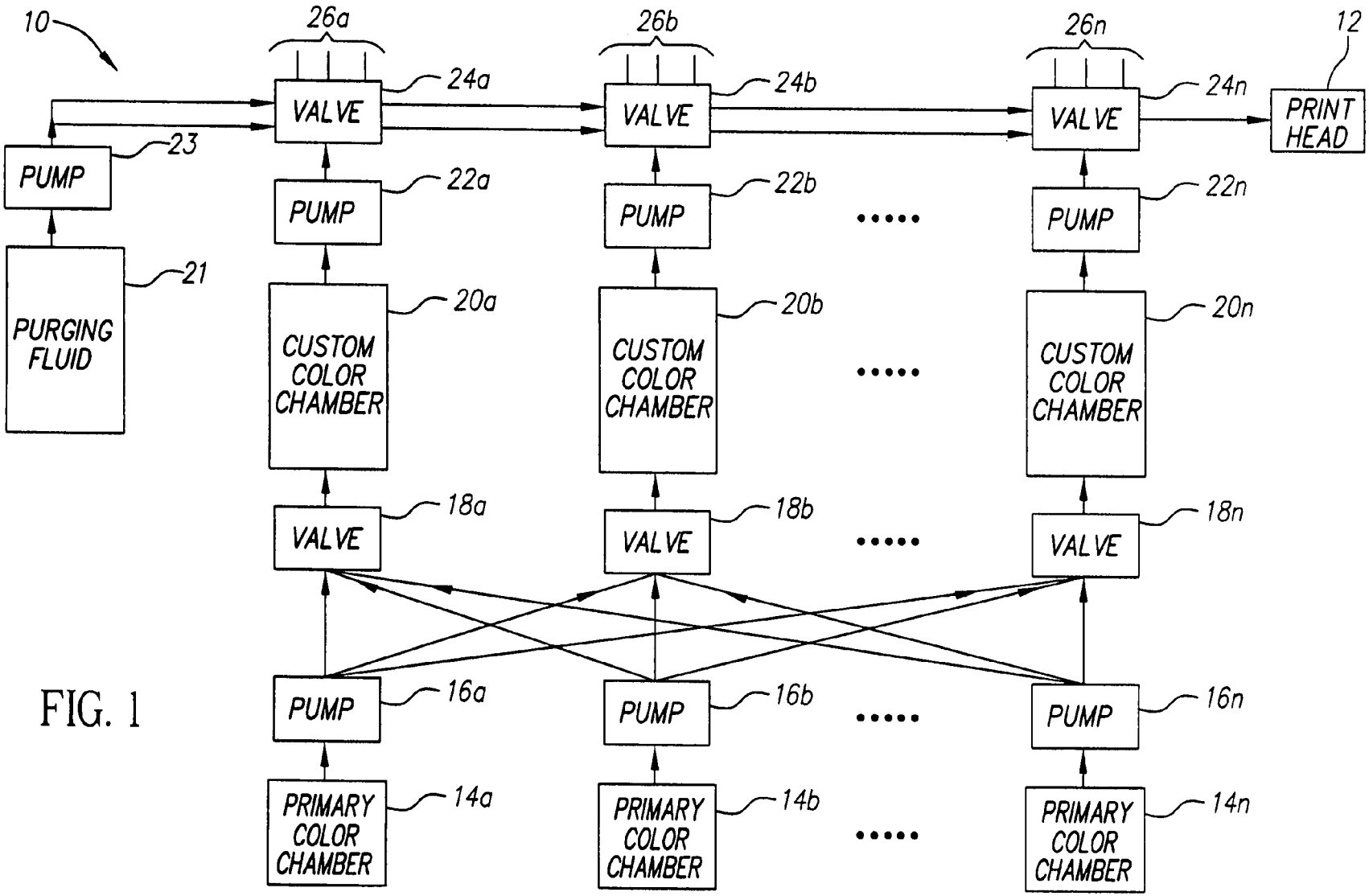
FIG. 1 is a schematic block diagram of a custom-color print apparatus.

As illustrated in FIG. 1, a custom color print apparatus 10 is provided for feeding custom ink colors to a print head 12 for printing custom accent colors, for example. The print head 12 may be, for example, an inkjet print head. The custom color print apparatus is provided with a number of primary color chambers 14*a*, 14*b*, and 14*n* for storing primary color ink (first primary color chamber, second primary color chamber, third primary color chamber, . . . n primary color chambers, where n is an integer number greater than 2). The number of primary color chambers is preferably at least two, but it may be any number as determined by appropriateness for any particular application. The primary color ink may include ink in the colors of cyan, magenta, yellow, black, and white. The term primary color ink as used herein is not limited to a "primary color" as defined under color theory. Rather, the term primary color ink is used herein to include any color of ink that may be mixed with another ink to form a custom color of ink.

Dispensing pumps 16*a*, 16*b*, 16*n* are provided to dispense a predetermined quantity (for example metered quantities) of the primary color ink to one or more custom color chambers 20*a*, 20*b*, 20*n* (first custom color chamber, second custom color chamber, third custom color chamber, . . . n custom color chambers, where n is an integer number greater than 1). As illustrated in FIG. 1, each custom color chamber is fitted with supply lines from each primary color. The custom color chambers need not be limited to separate containers but may be, for example a region of tubing in which inks are capable of blending.

Custom color selectors such as valves 18*a*, 18*b*, 18*n* may be provided to control the flow of primary color ink into the custom color chambers to ensure that primary color ink pumped by the dispensing pumps is directed into a selected one of the custom color chambers 20*a*, 20*b*, 20*n*. One or more of the valves 18*a*, 18*b*, 18*n* may comprise a dispensing valve operative to dispense a predetermined quantity (for example metered quantities) of ink into the custom color chamber, for example a low-resolution, low speed inkjet nozzle such as a Lee Valve (VHS-Lt Direct Dispensing Micro-Drop Valve, The Lee Company, Westbrook, Conn.), which can be used to put drops of primary color ink in the custom color chambers 20*a*, 20*b*, 20*n*. One such valve may be provided for each line leading from the primary color chambers to the secondary color chambers (e.g., an individual valve 18*a*, and/or 18*b*, . . . and/or 18*n*, may include two, three, or more Lee Valves, one for each of the primary color chambers 14*a*, 14*b*, and 14*n*).

Although three custom color chambers and three primary color chambers are illustrated in FIG. 1, the number of primary color chambers and custom color chambers need not be the same. In one embodiment, five primary color chambers might be used in conjunction with a single custom color chamber.

The custom color chambers 20*a*, 20*b*, 20*n* may be provided with one or more mixers (not illustrated), which may be, for example, mechanical, magnetic, pneumatic, hydraulic, or ultrasonic stirrers, powered by electricity or other suitable source. The custom color chambers may be removable for storage outside the color print apparatus, and/or to enable swapping of custom colors. Moreover, the custom color chambers may be disposable to simplify cleanup when a new custom color is desired. Preferably, where a previously-mixed color is obtained (such as a color mixed outside of the print apparatus), a chamber containing that color can be added to the print apparatus.

The custom color chambers 20*a*, 20*b*, 20*n* are associated with the print head 12. When printing is performed using custom colors, one or more feed pumps 22*a*, 22*b*, 22*n* feed custom color ink from the custom color chambers 20*a*, 20*b*, 20*n* through feed valves 24*a*, 24*b*, 24*n* to the print head 12.

A source of purging fluid is provided, such as a reservoir 21 with a pump 23 to pump the purging fluid through the portions of the color print apparatus such as the feed valves 24*a*, 24*b*, 24*n* and the print head 12. The purging fluid pump is operative to direct purging fluid from the purging fluid reservoir 21 to the feed valves 24*a*, 24*b*, 24*n*. The feed valves are operative to alternatively direct purging fluid from the purging fluid pump 23 or ink from a corresponding custom color chamber 20*a*, 20*b*, 20*n* to the print head 12. The purging fluid is used to clear one color of ink from the print apparatus when it is desired to switch to another color of ink, thereby preventing different ink colors from mixing unintentionally. The print apparatus can be purged by printing ink to a waste receptacle or to the receiver. The feed valves 24*a*, 24*b*, and 24*n* may be provided with bleed lines (illustrated in groups of three) 26*a*, 26*b*, and 26*n* to release purging fluid and/or excess ink from the apparatus.

The pumps in the apparatus may be systolic pumps. The term "pump," as used herein is broadly used to encompass various arrangements for propelling liquid, such as an arrangement for providing a pressure gradient or a gravity-feed arrangement.

Figure 2:
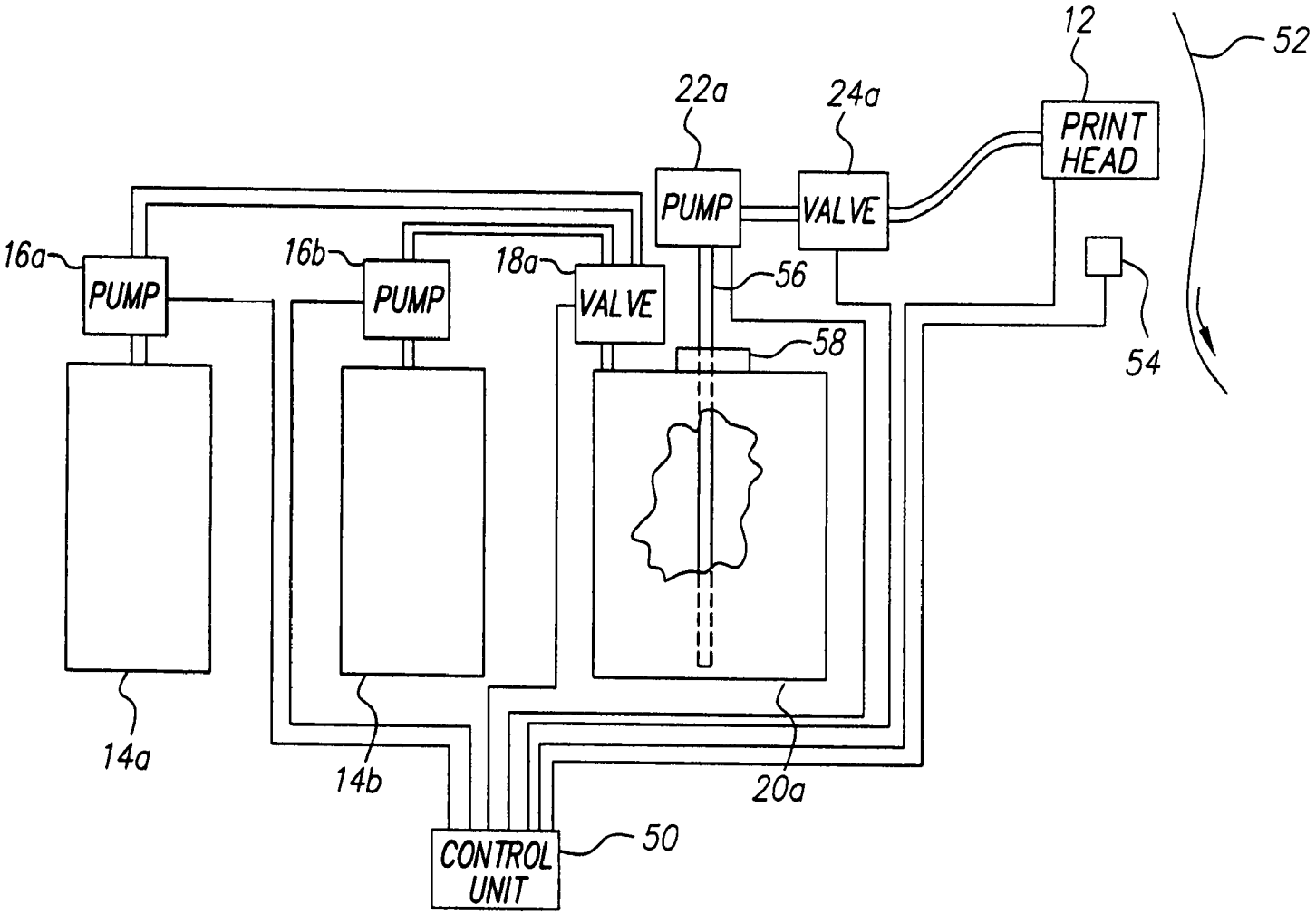
FIG. 2 is a schematic diagram of a custom-color print apparatus including a controller.

A schematic illustration of the print apparatus is provided in FIG. 2. Primary color chambers 14*a* and 14*b* are shown, together with dispensing pumps 16*a* and 16*b*, both of which feed to the valve 18*a* leading to the custom color chamber 20*a*. A feed tube 56 passes from the custom color chamber 20*a* through a wiper 58 to the feed pump 22*a*. The feed pump 22*a* draws the custom color through the feed tube 56 and provides it, through the valve 24*a*, to the print head 12. Additional components of the print apparatus, such as additional primary and/or custom color chambers and associated valves, are not illustrated in FIG. 2 for simplicity.

The print apparatus is preferably operated under the control of a controller 50, which may include a central processing unit (CPU), such as the CPU of a general-purpose computer programmed by software to operate the print apparatus, or a special-purpose computer or logic circuit designed to operate the print apparatus. The controller may accept an input indicating one or more custom colors to be used by the print apparatus. The input may accept a color identification through, for example, RGB value or Pantone number, or the input may include an optical scanner that reads a color sample to create a match, or the input may receive a formula that identifies proportions for mixing primary color inks to form a custom color. As the print head 12 prints on a receiver 52, such as a sheet of paper, a print color sensor 54 may detect the color printed by the print head 12. This sensing may be used to verify the changing of the color of ink printed by the print head 12, and the constancy of the ink color during print jobs. An ink color sensor 86 may be positioned to sense a color of ink in the custom color chamber. The sensors 52 and 86 may be optical sensors, for example, or any sensor suitable for sensing a print or ink color, respectively.

Based on the readings from the print sensor 54 and/or the ink sensor 86, the controller 50 may make corrections to the custom colors. The print apparatus may, for example, print one or more proofs monitored by the sensor 54, with the controller 50 controlling a cycle that may include adjusting the custom color ink, purging, and printing until the detected color on the page matches a desired custom color. The print sensor 54 may also be used to measure the color of the custom color portions of the image during print jobs. If this custom color varies from the specified color, it can be corrected during the print job by the controller 50 The controller 50 may be operative to induce dispensing of ink from one or more of the primary color chambers 14*a*, 14*b*, 14*n* into the custom color chamber 20*a*, 20*b*, 20*n* in order to match a color printed by the print head 12 to a predetermined print color with feedback from the print sensor 54. In similar manner, the controller 50 may be operative to induce dispensing of ink from one or more of the primary color chambers 14*a*, 14*b*, 14*n* into the custom color chamber 20*a*, 20*b*, 20*n* in order to match the color of ink in the custom color chamber 20*a*, 20*b*, 20*n* to a predetermined custom color of ink with feedback from the ink sensor 86. The controller 50 may be operative to report the color of ink in the custom color chamber 20*a*, 20*b*, 20*n*, and/or the color printed by the print head 50, to a print apparatus operator.

The print sensor 54 may be implemented to verify the changing of the color of ink printed by the print head. A change of the custom color to another custom color may be verified by printing the purging fluid and/or the another custom color on at least one receiver with the print head 50. The printing process may comprise directing the at least one receiver to a different destination than a bulk of receivers printed with the custom color, for example for proofing, or to a waste receptacle. The apparatus operator may verify the color change, or the controller 50 may be operative to verify the color change with feedback from the print sensor 54.

The primary color chambers 14*a*, 14*b*, 14*n*, color chambers 20*a*, 20*b*, 20*n*, and the purging fluid reservoir 21 may be provided with low-level sensors (not shown) to indicate when fluid levels are low. The controller 50 may be operative to halt printing by the print head 12 in response to the at least one low level sensor sensing a low fluid level and to notify a print apparatus operator.

Multiple sets of the custom color printing apparatus 10, each with at least one print head, may be included in a printing machine to print color separations sequentially in register on the receiver. These separations may contain primaries C,M,Y,K, custom colors, or other color sets, such as for duotones.

Figure 3A:
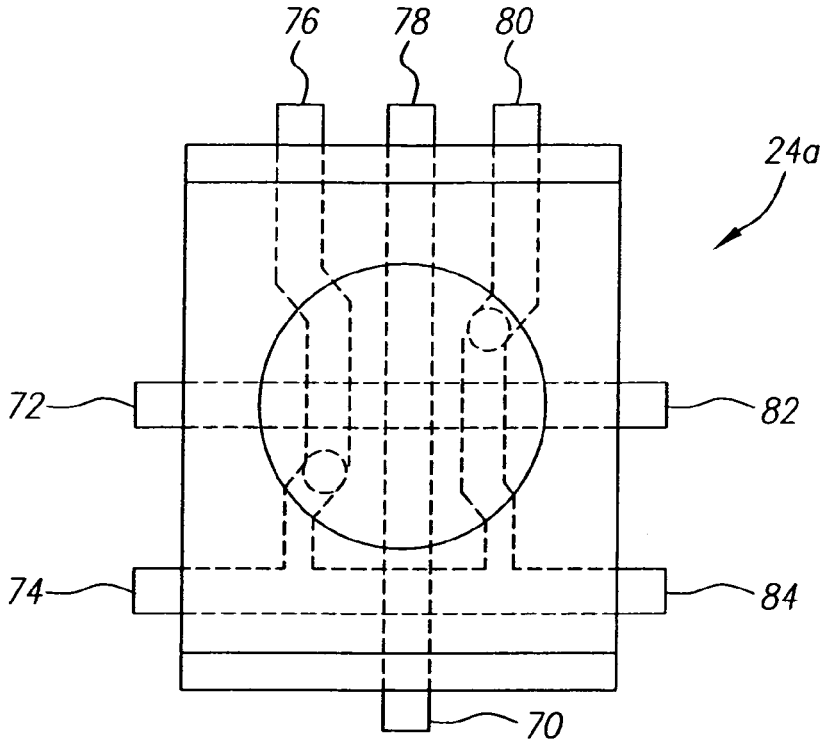
FIGS. 3*a* and 3*b* are plan views of a valve used in the custom-color print apparatus of FIGS. 1-2.
Figure 3B:
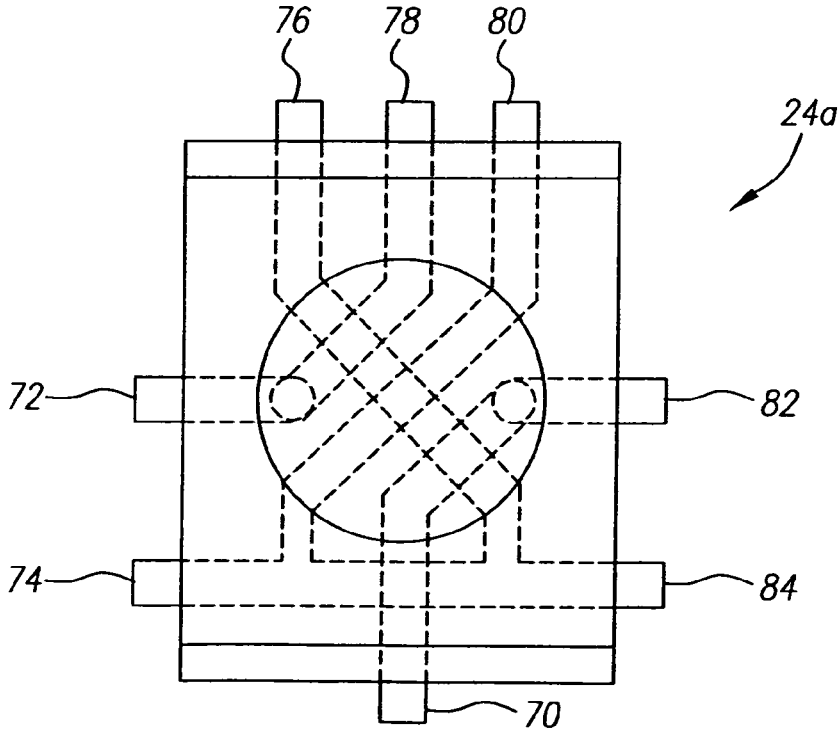

The valves of the apparatus are selected so that they do not retain fluid and are easily purged. They can be controlled by, for example, stepper motors or solenoids operated by the controller. One type of valve that is well adapted for use in the print apparatus as a feed valve, such as one or more of the valves 24*a*, 24*b*, and 24*n*, is illustrated in FIGS. 3*a* and 3*b*. The valve 24*a* includes external ports 70, 72, 74, 76, 78, 80, 82, and 84. The valve 24*a* also includes internal ports 73, 75, 79, and 83. The rotary portion of the valve contains straight passages 71 and 81. In the view shown in FIGS. 3*a* and 3*b*, passage 71 and 81 are at different levels, and passage 71 crosses over passage 81.

Correspondingly, passage 71 is shown with heavily dashed lines, and passage 81 is shown with lines having alternating dashed and dotted sections. The level of the other passages in the valve is indicated by like-dotted lines. For example, the passage from external port 74 to external port 84 is at the level of passage 81. The openings of internal ports 73, 75, 79, and 83 are enlarged to connect to openings in the rotary portion of the valve at either the level of passage 71 or the level of passage 81.

FIG. 3*a* illustrates the feed valve 24*a* in the bleed/prime position. The ports 72 and 74 are coupled to the purging fluid pump 23, the ports 76, 78, and 80 are coupled to the bleed lines 26*a* (see FIG. 1), and the ports 82 and 84 are coupled to the next feed valve 24*b*. In the bleed/purge position of FIG. 3*a*, the ports 70, 74, and 84 are all coupled to the bleed lines, while the port 72 flows to the port 82.

FIG. 3*b* illustrates the valve 24*a* in the feed position. In the feed position, the ports 72, 74, and 84 are coupled to the bleed lines, while the port 70 flows to the port 82. When the valve 24*a* is in either the feed position or in the bleed/prime position, a portion of the purging fluid fed into the port 74 flows out of the port 84, and a portion of the purging fluid fed into the port 74 pressurizes and purges the internal passages in the valve 24*a* that are not connected to the ports 72, 82, or 70. These passages are purged through the ports 76 and 80, which are coupled to the bleed lines 26*a* (see FIG. 1). Modifications and additions can be made to the valve arrangement shown in FIGS. 3*a* and 3*b* to adapt the system for long idle periods, evaporative ink, or infrequent ink changes. For example, the ports 76, 78, and 80 may be fitted with solenoid valves or other automated valves, and purging can be done at intervals. Port 70 may be fitted with a one-way valve only allowing passage of ink into valve 24*a*.

Passage 71 may be eliminated and the openings of internal ports 73 and 79 sized to connect only at the level of passage 81 if ink from port 70 is to be purged through the print head or through other ports downstream from port 84.

Figure 4:
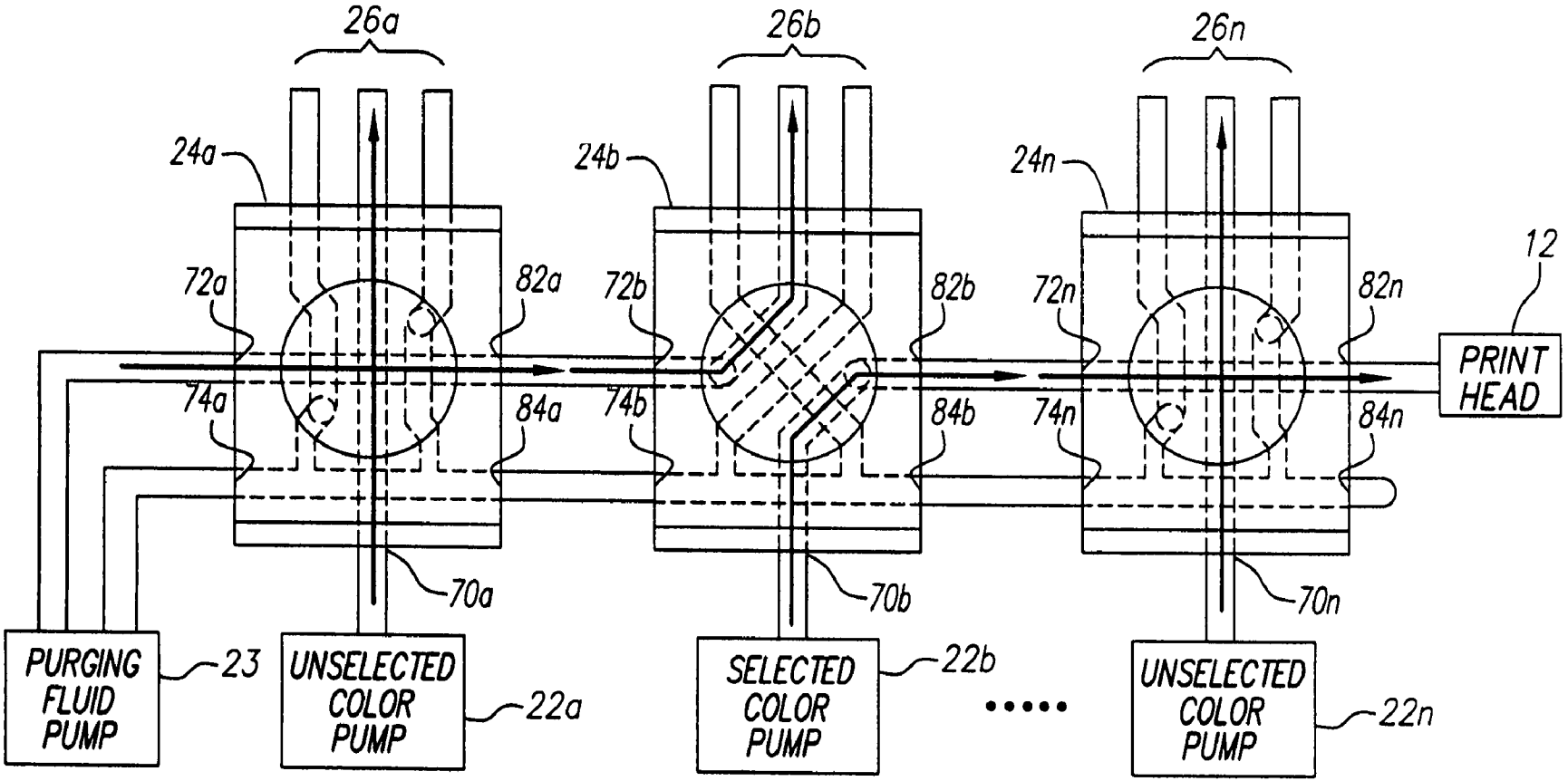
FIG. 4 is a partial schematic view of a custom-color print apparatus employing the valves of FIGS. 3*a* and 3*b*.

FIG. 4 illustrates the valves 24*a*, 24*b*, and 24*n* implemented in a print apparatus. In FIG. 4, the color associated with the pump 22*b* is the selected printing color. To print using the color associated with the pump 22*b*, the valve 24*b* is arranged in the feed position (see FIG. 3*b*). The remaining valves in the apparatus are arranged in the bleed/prime position (see FIG. 3*a*). In this arrangement, when custom color ink is pumped by the selected pump 22*b*, the ink is directed by the valve 24*b* to the print head 12. Any flow from the unselected color pumps 22*a*, 22*n* and from the purging fluid pump 23 is directed to one or more of the bleed lines 26*a*, 26*b*, 26*n*. The flow of the ink and purging fluid is illustrated in part by arrows drawn through the valves 24*a*, 24*b*, and 24*n*. (Arrows are omitted from other potential fluid paths to enhance readability.) The line or tube connecting the ports 72*a*, 72*b*, 72*n* and 82*a*, 82*b*, 82*n* is the main ink line and can contain either ink, purge fluid, or a mixture of ink and purge fluid in normal operation. The line or tube connecting the ports 74*a*, 74*b*, 74*n* and 84*a*, 84*b*, 84*n* is an auxiliary line that contains purge fluid in normal operation.

The color print apparatus operates as follows, with steps that may be taken under the direction of the controller 50:

To purge custom colors, the feed valves are set to bleed/prime, the custom colors chambers are pumped at bleed pressure or bleed speed (low speed), and purging fluid is run through the print head until the output is clear.

To make a new custom color, controlled amounts of primary color ink are provided to one of the custom color chambers and are mixed or allowed to mix.

To start printing the new color from a custom color chamber (e.g., the chamber 20*b*), the color is primed, the associated feed valve 24*b* is set to feed, and the ink is pumped at purging speed through the print head. When the print head is loaded with the new color, printing is started. All other valves (24*a* and 24*n*) are set to bleed/prime. The valve 24*n* will pass fluid sent through the upstream valves to print head 12. Passages in valve 24*n* that are not connected to print head 12 are purged to the bleed lines 26*n* or pass ink from deselected color pump 22*n* to the bleed lines 26*n*. The purging fluid is fed at bleed pressure or bleed speed. Passages in valves that are set to feed or are set to bleed/prime are filled with either purge fluid, ink, or a mixture of purge fluid and ink. The passages in valves 26*a*, 26*b*, and 26*n* are always filled with fluid so that changing valve settings does not introduce air bubbles into the ink lines. In such manner, the feed valves 24 are operative to alternatively direct purging fluid from the purging fluid source 21/23 or ink from the custom color chamber 20 to the print head 12 without generating bubbles in the feed valve.

To use a premixed color, one of the custom color chambers (such as chamber 20*a*) is removed and the feed tube 56 is cleaned as necessary, possibly during removal by the wiper 58 or a sponge or squeegee attached to the chamber. While the chamber 20*a* is removed, pumping from that chamber is disabled. The premixed color chamber with the desired color is installed and the new color is primed. This can be done during a printing operation.

The controller 50 and supporting software are implemented to control the various functions described herein. Such implementation is well within ordinary skill in the relevant art. It should be understood that the programs, processes, methods and apparatus described herein are not related or limited to any particular type of computer or network apparatus (hardware or software), unless indicated otherwise. Various types of general purpose or specialized computer apparatus may be used with or perform operations in accordance with the teachings described herein. The control implementation may be expressed in software, hardware, and/or firmware.

Although the invention has been described and illustrated with reference to specific illustrative embodiments thereof, it is not intended that the invention be limited to those illustrative embodiments. Those skilled in the art will recognize that variations and modifications can be made without departing from the true scope and spirit of the invention as defined by the claims that follow. It is therefore intended to include within the invention all such variations and modifications as fall within the scope of the appended claims and equivalents thereof. The claims should not be read as limited to the described order or elements unless stated to that effect. In addition, use of the term "means" in any claim is intended to invoke 35 U.S.C. §112, paragraph 6, and any claim without the word "means" is not so intended.

What is claimed is:

1. A print apparatus, comprising:

a first primary color chamber;

a second primary color chamber;

a custom color chamber in communication with the first and second primary color chambers;

a first pump operative to dispense a measured amount of ink from the first primary color chamber to the custom color chamber;

a second pump operative to dispense a measured amount of ink from the second primary color chamber to the custom color chamber;

a print head, in communication with a purging fluid via a feed valve, operative to print with ink from the custom color chamber; and the feed valve located intermediate the custom color chamber and the print head with two or more connected and not-connected internal passageways wherein one or more passageways are connected and one or more passageways are not-connected between the custom color chamber and the print head as well as between the purging fluid and the print head to alternately direct purging fluid or ink through the connected and not-connected internal passageways allow passage of fluid.

2. The print apparatus of claim 1, comprising n primary color chambers, where n is an integer number greater than 2.

3. The print apparatus of claim 1, comprising n custom color chambers, where n is an integer number greater than 1.

4. The print apparatus of claim 1, further comprising a purging fluid reservoir and a purging fluid source operative to purge a custom color ink with the purging fluid via the internal passageways not-connected to the custom color chamber.

5. The print apparatus of claim 1, comprising:

a purging fluid reservoir;

a purging fluid pump operative to direct purging fluid from the purging fluid reservoir to the feed valve;

the feed valve being operative to alternatively direct purging fluid from the purging fluid pump or ink from the custom color chamber to the print head so all the internal passageways, connected and not-connected to the custom color chamber, are moving either purge fluid or ink.

6. The print apparatus of claim 1, comprising:

a purging fluid reservoir;

a purging fluid pump operative to direct purging fluid from the purging fluid reservoir to the feed valve;

the feed valve being operative to alternatively direct purging fluid from the purging fluid pump or ink from the custom color chamber to the print head without generating bubbles in the feed valve.

7. The print apparatus of claim 1, comprising a dispensing valve operative to dispense a predetermined quantity of ink into the custom color chamber.

8. The print apparatus of claim 1, comprising:

a controller operative to induce dispensing of ink from one or more of the primary color chambers into the custom color chamber in order to match a color of ink in the custom color chamber to a predetermined custom color of ink.

9. The print apparatus of claim 1, comprising:

an ink sensor positioned to sense a color of ink in the custom color chamber; and a controller operative to induce dispensing of ink from one or more of the primary color chambers into the custom color chamber in order to match the color of ink in the custom color chamber to a predetermined custom color of ink with feedback from the ink sensor.

10. The print apparatus of claim 1, comprising:

a controller operative to induce dispensing of ink from one or more of the primary color chambers into the custom color chamber in order to match a color of ink printed by the print head to a predetermined printed color of ink.

11. The print apparatus of claim 1, comprising:

a print sensor positioned to sense a color of ink printed by the print head; and a controller operative to induce dispensing of ink from one or more of the primary color chambers into the custom color chamber in order to match the color of ink printed by the print head to a predetermined print color with feedback from the print sensor.

12. The print apparatus of claim 1, the custom color chamber being removable from the print apparatus.

13. The print apparatus of claim 1, at least one low level sensor positioned to sense a low fluid level in at least one of the first primary color chamber, the second primary color chamber, and the custom color chamber.

14. The print apparatus of claim 13, comprising a controller operative to halt printing by the print head in response to the at least one low level sensor sensing a low fluid level and to notify a print apparatus operator.

15. The print apparatus of claim 13, comprising a controller operative to halt printing by the print head in response to the at least one low level sensor sensing a low fluid level.

16. The print apparatus of claim 1, comprising a purging fluid reservoir and a purging fluid pump operative to purge the print head with purging fluid via the internal passageways not-connected to the custom color chamber.

17. The print apparatus of claim 16 at least one low level sensor positioned to sense a low fluid level in the purging fluid reservoir.

18. The print apparatus of claim 16, comprising a controller operative to halt printing by the print head in response to the at least one low level sensor sensing a low fluid level.

19. The print apparatus of claim 1, comprising an ink sensor positioned to sense a color of ink in the custom color chamber.

20. The print apparatus of claim 19, comprising a controller operative to report the color of ink in the custom color chamber to a print apparatus operator.

21. The print apparatus of claim 1, comprising a print sensor positioned to sense a color of ink printed by the print head.

22. The print apparatus of claim 21, comprising a controller operative to report the color of ink printed by the print head to a print apparatus operator.

* * * * *